US006578616B2

(12) United States Patent
Stein et al.

(10) Patent No.: US 6,578,616 B2
(45) Date of Patent: Jun. 17, 2003

(54) ROLL CHANGER FOR AN APPARATUS FOR PRODUCING HYGIENIC PRODUCTS

(75) Inventors: Wolfgang Stein, Neuwied (DE); Reiner Seger, Neuwied (DE)

(73) Assignee: Winkler + Duennebier AG, Neuwied (DE)

( * ) Notice: Subject to any disclaimer, the term of this patent is extended or adjusted under 35 U.S.C. 154(b) by 114 days.

(21) Appl. No.: 09/804,537

(22) Filed: Mar. 9, 2001

(65) Prior Publication Data

US 2001/0020664 A1 Sep. 13, 2001

(30) Foreign Application Priority Data

Mar. 11, 2000 (DE) ..... 100 12 000

(51) Int. Cl.[7] ..... B65H 21/00

(52) U.S. Cl. ..... 156/504; 156/502; 156/157; 242/555.4

(58) Field of Search ..... 156/157, 159, 156/502, 504; 242/551, 555.3, 555.4

(56) References Cited

U.S. PATENT DOCUMENTS

| | | | | | |
|---|---|---|---|---|---|
| 3,841,944 | A | * | 10/1974 | Harris, Jr. | 156/159 |
| 4,100,012 | A | * | 7/1978 | Meihofer et al. | 156/351 |
| 4,219,378 | A | * | 8/1980 | Marschke | 156/157 |
| 5,360,502 | A | * | 11/1994 | Andersson | 156/159 |
| 5,427,639 | A | * | 6/1995 | Minarelli | 156/157 |
| 5,443,681 | A | * | 8/1995 | Stivani et al. | 156/159 |

* cited by examiner

*Primary Examiner*—Mark A. Osele
(74) *Attorney, Agent, or Firm*—W. F. Fasse; W. G. Fasse

(57) ABSTRACT

A roll changer for splicing starting piece and end pieces of material webs to each other in an apparatus for producing hygienic products, includes carriers for web rolls, holding and guiding elements, severing elements and embossing rolls. The starting piece of a new material web can be fixed to an embossing roll. At least one embossing roll can be driven and at least one embossing roll can be moved selectively toward and away from the other embossing roll.

15 Claims, 4 Drawing Sheets

17
16,16'
19
25
18
12
23
21
22
20
22
20
19
24
16,16'
18
2
3
17
11

ROLL CHANGER FOR AN APPARATUS FOR PRODUCING HYGIENIC PRODUCTS

FIELD OF INVENTION

The invention relates to a roll changer for splicing starting pieces and end pieces of material webs in an apparatus for producing hygienic products.

BACKGROUND INFORMATION

A method and an apparatus of the type of interest here are known in principle from EP 0 525 075 B1. This document describes a method and an apparatus for splicing at least two materials containing two single-ply or multi-ply, air permeable and soft paper webs. The material webs are joined by being spliced in the nip of two embossing rolls. The starting piece of the material web to be joined is initially held with the aid of a suction box, whose holding force is canceled when the web is to be joined to the end of piece of the other web.

The problem with the known apparatus is that it is necessary to operate there with a very accurately defined vacuum. Controlling the vacuum is therefore difficult. In addition, the fact that the end piece of one web has to pull the starting piece of the web to be joined to it is not without problems, although both webs, before entering the nip of the embossing rolls, are sucked against a suction box by vacuum.

SUMMARY OF THE INVENTION

The invention is therefore based on the object of providing the conditions for the most simple and quick roll change which may be carried out with only little effort.

In order to achieve this object, the invention provides, in a roll changer for splicing a starting piece to an end piece of successive material webs, for the starting piece of a new material web to be capable of being fixed to an embossing roll, and for at least one embossing roll to be capable of being driven and for at least one embossing roll to be capable of being moved toward the other embossing roll and away from it.

During production, the unwinding material web moves through the embossing nip without touching an embossing roll. Both embossing rolls are therefore stopped during production. According to the invention, the starting piece of the material web to be joined is fixed directly to one of the two stationary embossing rolls. For this purpose, both embossing rolls preferably have a suction strip or a row of suction openings and can be connected to vacuum lines.

In order to splice the materials webs, the two embossing rolls are pressed against each other and set rotating. In the process, the two material webs are joined by pressure and deformation in the manner of a splice, the end piece of one material web then being severed following the production of the splice.

The aforesaid measures can be prepared easily. The actual splicing operation can then be carried out securely and reliably. This results in a rapid roll change with a short transition from the end of one material web to the start of the next material web.

BRIEF DESCRIPTION OF THE DRAWINGS

The invention will be described in more detail below using an exemplary embodiment which is illustrated in the drawing, in which.

DETAILED DESCRIPTION OF A PREFERRED EXAMPLE EMBODIMENT OF THE INVENTION

Figure 1:
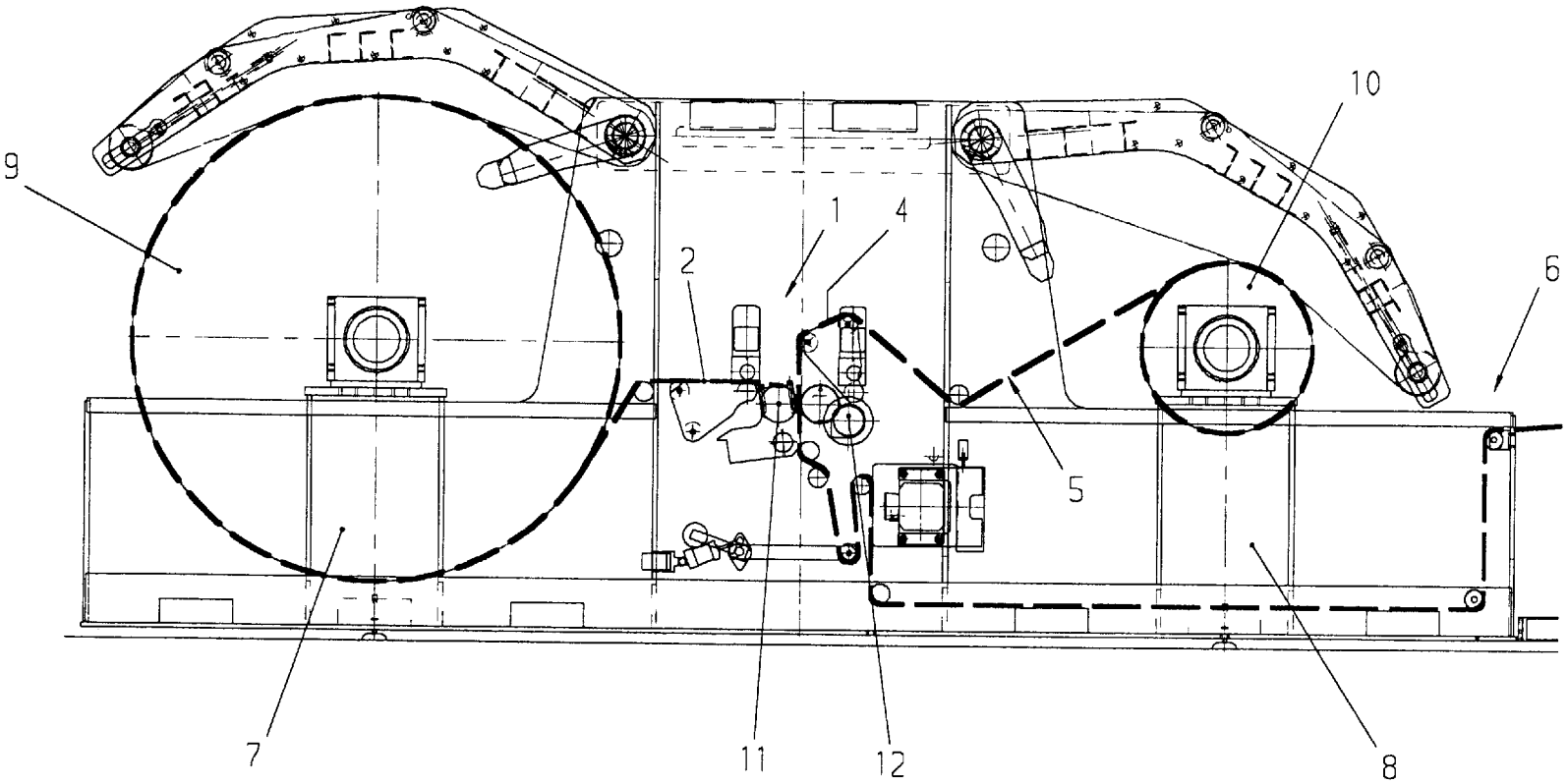
FIG. 1 shows a basic sketch of essential parts of the roll changer and the apparatus belonging to it.

A roll changer 1 for splicing a starting piece 2 of a material web 3 to an end piece 4 of another material web 5 in an apparatus 6 for producing hygienic products comprises carriers 7 and 8 for web rolls 9 and 10 and embossing rolls 11 and 12, with the aid of which the starting piece 2 is pressed onto the end piece 4 during a passage through a nip 40 between the two embossing rolls 11 and 12. The two embossing rolls 11, 12 have free-rotation devices (not illustrated) such that the embossing roll 11 can be rotated only the direction of the arrow 24 and the embossing roll 12 can be rotated only in the direction of the arrow 25. By means of suitable non-return blocking means, the embossing roll 11 can therefore be rotated only in the clockwise direction in FIG. 2 and the embossing roll 12 can be rotated only in the counterclockwise direction.

Figure 2:
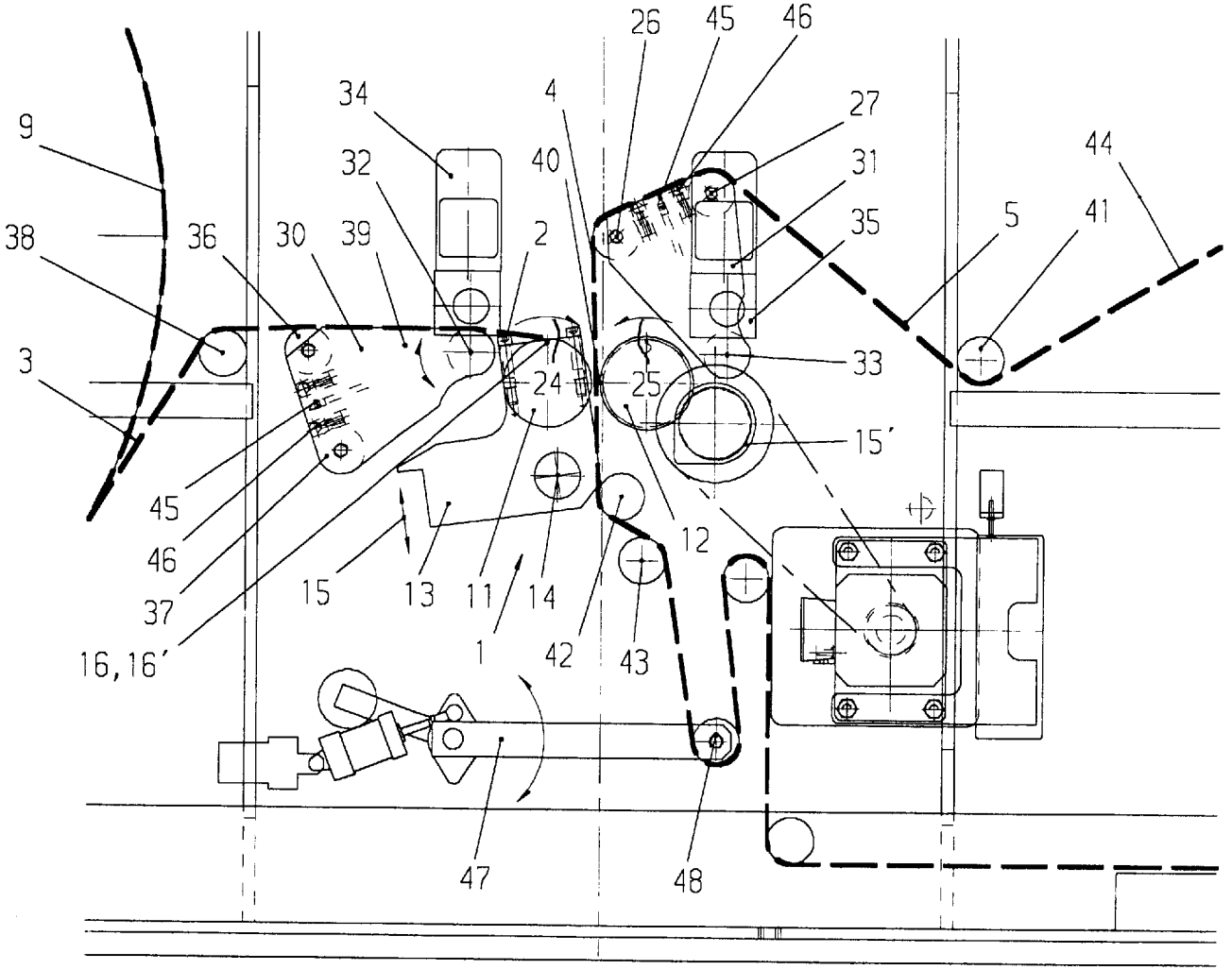
FIG. 2 shows a detail from FIG. 1 on an enlarged scale.

One embossing roll 11 can be moved toward the other embossing roll 12 and away from it. To this end, the embossing roll 11 is mounted on a carrier 13 and, together with the carrier 13, can be pivoted about an axis 14. A controllable drive 15 is used to adjust and to fix the carrier 13 in the pressing and splicing position of the embossing roll 11 (FIG. 2).

The other embossing roll 12 is mounted in a stationary position. In addition, the embossing roll 12 is assigned a drive 15', with the aid of which it is possible not only to set the embossing roll 12 rotating positively, but also the embossing roll 11 pressed in the direction of the embossing roll 12 during the splicing of the material webs 3 and 5. The driven embossing roll 12 drives the not self-driven embossing roll 11 with it during splicing, on account of a frictional connection.

Figure 3:
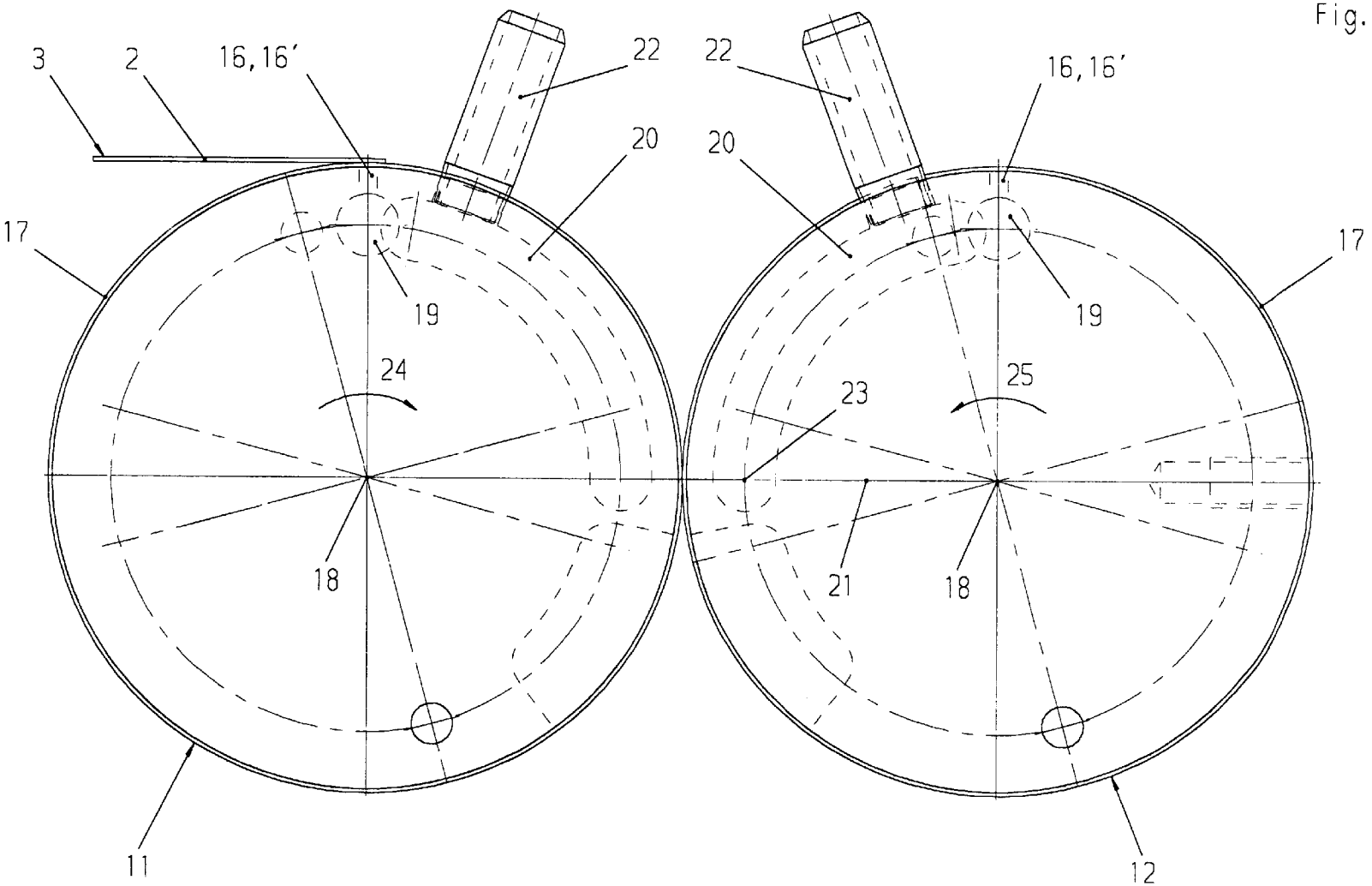
FIG. 3 shows an end view of the two embossing rolls on a further enlarged scale.
Figure 4:
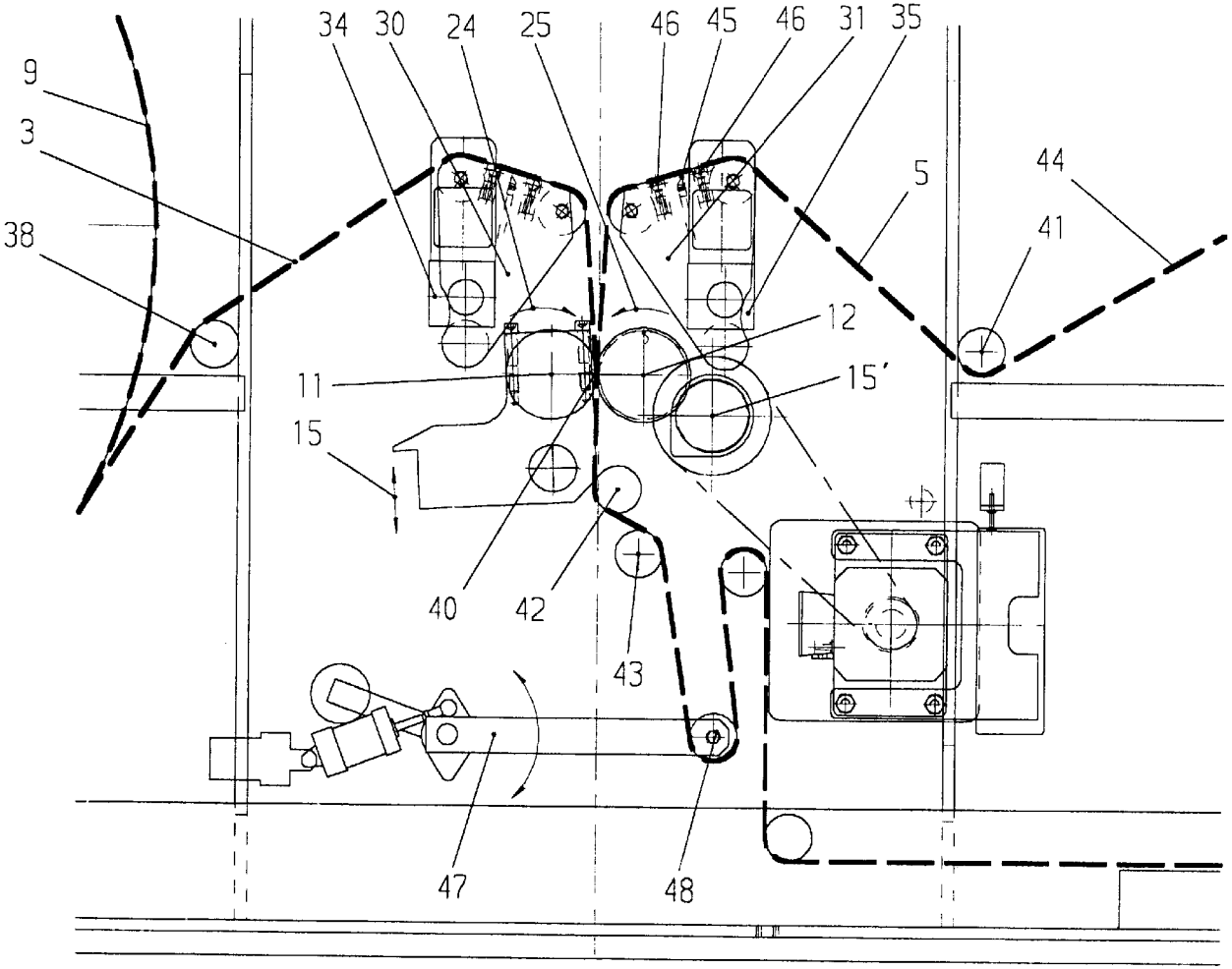
FIG. 4 shows a view similar to that of FIG. 2 during the splicing operation.

The two embossing rolls 11 and 12 are illustrated on an enlarged scale in FIG. 3 and reveal that each embossing roll 11, 12 has a holding element 16 for the starting piece of a material web. According to the exemplary embodiment, the holding element 16 is a suction strip or comprises a row of suction openings 16', which are each arranged on the circumference 17, parallel to the axis 18 of each embossing roll 11, 12, In each case via a suction duct 19 having a control window at a front end of each embossing roll 11, 12, an air-carrying connection to a suction and control duct 20 is also provided, said duct extending in an arc along the movement path of the suction duct 19 or control window in a stationary control disk arranged at one end beside the embossing roll. The suction and control ducts 20 in the two control disks are oriented toward each other, according to FIG. 3, and each extend over about 90° and end at the same height, approximately on a connecting line 21 between the two axes 18.

In addition, the two arcuate suction and control ducts 20 are each connected to a vacuum line 22 which, depending on the operating state, supplies neither or one or the other embossing roll 11, 12 with vacuum in the area of the suction openings 16'.

The roll changer 1 further comprises holding and guiding elements 30 and 31 which, firstly, act during normal operation and, secondly, act during the preparation and production of a splice. They are mounted such that they can each be pivoted about an axis 32 and 33, respectively, with the aid of drives 34, 35, and are arranged substantially symmetrically in relation to the two embossing rolls 11, 12. The holding and guiding elements 30, 31 each have a guide face 39 and can be moved into a position in which the guide face 39 lies in a plane that is tangential to the two embossing rolls 11, 12.

On its circumference, each holding and guiding element 30, 31 has at least one deflection element 26 and 36 and, according to the exemplary embodiment, in each case two deflection elements 26, 27 and 36, 37 for the respective material web 3 and 5. Together with the pivot axes 32, 33 and the deflection elements 26, 27 and 36, 37, the holding and guiding elements 31, 32 in each case form approximately triangles.

According to the illustration in FIG. 2, the material web 5 is used for the production of parts. The continuously unwinding material web 5 is led over the holding and guiding element 31, which in this case is pivoted up. The material web 5 runs from a deflection element 41 which is arranged in a stationary position to the deflection elements 26 and 27 on the circumference of the holding and guiding element 31 and then, without contact, through the nip 40 to further deflection elements 42 and 43 and so on. The operating position of the holding and guiding element 31 with its deflection elements 26 upstream of the nip 40, and the position of the deflection element 42 downstream of the nip 40 are in principle selected such that the normal, operational passage of the material web 5 is carried out without any contact with the embossing rolls 11 or 12.

During production with the material web 5, the embossing roll 11 is moved out of its embossing position (in the counterclockwise direction in FIG. 2) in order to produce the widest possible embossing roll gap 40, and is also moved away from the embossing roll 12. The material web 5 therefore runs between the deflection element 26 and the deflection element 42 without contact through the opened embossing roll gap 40. At the same time, the holding and guiding element 30 is pivoted so that its guide face 39 is brought into a horizontal position (FIG. 2) in order to prepare the next splicing operation with the starting piece 2 of the material web 3.

The new material web 3 is pulled with its starting piece 2 over the deflection elements 38 and 36 in order to prepare a splicing operation, and fixed to the embossing roll 11 with the aid of the holding element 16 or the suction openings 16'. To this end, the suction openings 16' on the embossing roll 11 have vacuum applied to them, while the suction air on the embossing roll 12 remains switched off.

The embossing roll 11 is then rotated onward in the clockwise direction or in the direction of the arrow 24 by about 90°, until the starting piece 2 is placed securely in the opened embossing roll gap 40.

Then, the holding and guiding element 30 is pivoted up, with the aid of the drive 34, into an unwinding position (FIG. 2). By means of the freewheel integrated in the embossing roll 11, the embossing roll 11 is prevented from rotating back. At the same time, the material web 3 is pulled off from the web roll 9.

The embossing roll 11 is then moved in the direction of the embossing roll 12 with the aid of the drive 15, the starting piece 2 of the material web 3 being pressed against the material web 5. At the same time, the embossing roll 12 is set rotating in the direction of the arrow 25 with the aid of its drive 15', the embossing roll 11 being co-rotated in the direction of the arrow 24 and the material webs 3 and 5 being embossed with each other. Directly after the start of the rotation of the embossing roll 11, the vacuum prevailing at its suction openings 16' is interrupted and, at the holding and guiding element 31, the end piece 4 is severed from the remainder 44 of the material web 5 with the aid of a severing element 45. Also provided, in addition to the severing element 45, are devices 46 for holding the material web during the severing cut.

As soon as the end piece 4 has been embossed with the new material web 3, the embossing roll 11 is removed from the embossing roll 12 again, so that a wide embossing roll gap 40 is produced between them. At the same time, the drive 15' is stopped. The new material web 3 then runs between the deflection elements 36 and 42 without contact through the gap 40.

The holding and guiding element 31 is subsequently pivoted back into its horizontal position, and therefore clears the way for the preparation of a new web roll 10, whose web start is joined to the web end of the material web 3 in the same way by embossing when this web has been processed.

In accordance with the different requirements, the two holding and guiding elements 30 and 31 are located in different positions and — as referred to the plane defined by the embossing nip 40—can be moved toward each other and away from each other. During operation, one holding and guiding element 31 is substantially vertical, while the other holding and guiding element is pivoted into an approximately horizontal position.

The deflection elements 36 to 38 can in each case be deflection rollers, just like the other deflection elements 41 to 43.

The material web is supplied to the production apparatus 6 via a tensioning device 47, which is known in principle and has a deflection roller 48.

What is claimed is:

1. A roll changer for splicing starting pieces (2) and end pieces (4) of material webs (3, 5) to each other in an apparatus (6) for producing hygienic products, comprising carriers (7, 8) for web rolls (9, 10), holding and guiding elements (30, 31), severing elements (45) and embossing rolls (11, 12), wherein the starting piece (2) of a new material web (3) can be fixed to an embossing roll (11 or 12), wherein at least one embossing roll (12) can be driven and at least one embossing roll (11) can be moved toward the other embossing roll (12) and away from it, and wherein the holding and guiding elements (30, 31) each have a guide face (39) and can be moved into a position in which the guide face (39) lies in a plane that is tangential to the two embossing rolls (11, 12).

2. The roll changer as claimed in claim 1, wherein two of the holding and guiding elements (30, 31), which are mounted such that they can move, are arranged upstream of the embossing rolls (11, 12) in the running direction of the material webs (3, 5).

3. The roll changer as claimed in claim 2, wherein the two holding and guiding elements (30, 31) are arranged symmetrically with regard to the two embossing rolls (11, 12).

4. The roll changer as claimed in claim 2, wherein the two holding and guiding elements (30, 31) can be pivoted about axes (32, 33).

5. The roll changer as claimed in claim 1, wherein each embossing roll (11, 12) has a holding element (16) for the starting piece (2) of a material web (3).

6. The roll changer as claimed in claim 5, wherein the holding element (16) provided is at least one suction strip or a row of suction openings (16') and can be connected to a vacuum line (22).

7. The roll changer as claimed in claim 1, wherein at least one of the holding and guiding elements (30, 31) has a device (46) for holding the material web (3, 5) during a severing cut.

8. The roll changer as claimed in claim 1, wherein each holding and guiding element (30, 31) has at least one deflection element (36, 37) on its circumference.

9. The roll changer as claimed in claim 8, wherein each holding and guiding element (30, 31) has two deflection elements (26, 27 and 36, 37) which, together with a pivot axis (32, 33) of the holding and guiding element (30, 31), form a triangle.

10. The roll changer as claimed in claim 9, wherein a respective severing element (45) is arranged between the two deflection elements (26, 27 and 36, 37) of each holding and guiding element.

11. The roll changer as claimed in claim 8, wherein the deflection element (36, 37) is a deflection roller.

12. The roll changer as claimed in claim 1, wherein the holding and guiding elements (30, 31) can be moved toward each other and away from each other relative to a plane defined by a nip (40) between the embossing rolls.

13. The roll changer as claimed in claim 1, wherein each one of the holding and guiding elements (30, 31), when in operation, leads the material web (3, 5) through an embossing roll gap (40) between the embossing rolls without contact.

14. The roll changer as claimed in claim 13, wherein a deflection element (42) is assigned to both embossing rolls (11, 12), and the holding and guiding elements (30, 31) can be moved and fixed, both in such a way that an unwinding material web (5) touches neither of the two embossing rolls (11, 12).

15. The roll changer as claimed in claim 1, wherein the guide face (39) of a respective one of the holding and guiding elements (30, 31) is located in a horizontal position when the new material web (3, 5) is being fixed to a respective one of the embossing rolls (11, 12).

* * * * *